US009966682B2

(12) United States Patent
Hatasa et al.

(10) Patent No.: US 9,966,682 B2
(45) Date of Patent: May 8, 2018

(54) CONNECTOR

(71) Applicant: TOYOTA JIDOSHA KABUSHIKI KAISHA, Toyota-shi, Aichi-ken (JP)

(72) Inventors: Keita Hatasa, Miyoshi (JP); Makoto Imai, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days. days.

(21) Appl. No.: 15/358,365

(22) Filed: Nov. 22, 2016

(65) Prior Publication Data

US 2017/0162970 A1 Jun. 8, 2017

(30) Foreign Application Priority Data

Dec. 3, 2015 (JP) ..... 2015-236763

(51) Int. Cl.

| | |
|---|---|
| ***H01R 31/08*** | (2006.01) |
| ***H01R 13/11*** | (2006.01) |
| ***H01R 12/57*** | (2011.01) |
| ***H01R 13/405*** | (2006.01) |

(52) U.S. Cl.

CPC ..... *H01R 13/111* (2013.01); *H01R 12/57* (2013.01); *H01R 13/405* (2013.01); *H01R 31/08* (2013.01)

(58) Field of Classification Search

CPC ..... H01R 13/405; H01R 12/57; H01R 13/111

USPC ..... 439/723, 507, 510, 512, 513, 509

See application file for complete search history.

(56) References Cited

U.S. PATENT DOCUMENTS

| | | | | |
|---|---|---|---|---|
| 4,659,158 A * | 4/1987 | Sakamoto | H01R 13/422 | 439/507 |
| 5,782,655 A * | 7/1998 | Stefaniu | H01R 13/11 | 439/510 |
| 5,882,231 A * | 3/1999 | Takano | H01H 1/5866 | 439/723 |
| 6,746,275 B2 * | 6/2004 | Yamakawa | H01R 13/701 | 439/507 |
| 2012/0282802 A1 * | 11/2012 | Funamura | H01R 31/08 | 439/507 |

(Continued)

FOREIGN PATENT DOCUMENTS

| | | |
|---|---|---|
| JP | S62-160479 U | 10/1987 |
| JP | 2014-010949 A | 1/2014 |
| JP | 2015-146289 A | 8/2015 |

OTHER PUBLICATIONS

Partial translation of Jan. 16, 2018 Office Action issued in Japanese Patent Application No. 2015-236763.

*Primary Examiner* — Abdullah Riyami
*Assistant Examiner* — Nelson R Burgos-Guntin
(74) *Attorney, Agent, or Firm* — Oliff PLC

(57) ABSTRACT

A female connection terminal includes a first female terminal having a substantially cylindrical shape with openings at one end and another end, a second female terminal having a substantially cylindrical shape with openings at one end and another end, and a coupling spring coupling together the first female terminal and the second female terminal at the other end of the first female terminal and the other end of the second female terminal. The coupling spring connects the first female terminal and the second female terminal to each other without, when viewed from an upper side, overlapping at least one of the openings of the first female terminal on the other end side and at least one of the openings of the second female terminal on the other end side.

9 Claims, 4 Drawing Sheets

(56) References Cited

U.S. PATENT DOCUMENTS

| | | | | |
|---|---|---|---|---|
| 2015/0064985 | A1* | 3/2015 | King, Jr. ..... | H01R 13/5213<br>439/723 |
| 2015/0111419 | A1* | 4/2015 | Komiyama ..... | H01R 13/11<br>439/510 |
| 2015/0222046 | A1 | 8/2015 | Akiguchi et al. | |

* cited by examiner

CONNECTOR

INCORPORATION BY REFERENCE

The disclosure of Japanese Patent Application No. 2015-236763 filed on Dec. 3, 2015 including the specification, drawings and abstract is incorporated herein by reference in its entirety.

BACKGROUND

1. Technical Field

The present disclosure relates to a connector mounted on a substrate.

2. Description of Related Art

Connectors used in a vehicle etc. are subjected to various forms of vibration. For connectors that are used to connect terminals having different forms of vibration to each other, it is necessary to prevent deformation and damage resulting from a relative positional shift between the terminals that are displaced in different manners, sliding between the terminals, and other causes.

For example, Japanese Patent Application Publication No. 2014-010949 and Japanese Patent Application Publication No. 2015-146289 disclose connectors that connect two male terminals having different forms of vibration, namely, one male terminal fixed on a substrate and the other male terminal fixed on a member (electrical device etc.) other than the substrate, to each other with a female connection terminal employing a coupling spring, and thus can reduce deformation and damage by absorbing a difference in displacement between the male terminals.

SUMMARY

In the connectors of the related art described in JP 2014-010949 A and JP 2015-146289 A, the coupling spring that absorbs a difference in displacement between the male terminals couples at side walls of two female terminals that are farthest apart from each other. Accordingly, the connectors of the related art make it difficult to view the fitted state of the female terminals and the male terminals from above the coupling spring. Moreover, the connectors of the related art make it difficult to protrude the leading ends of the male terminals through the openings of the female terminals to the upper side beyond the coupling spring. Thus, the connectors of the related art do not allow one to easily perform a check for the fit of the male terminals with each other, an electrical inspection on the terminals, etc.

According to the recent improvement in vibration absorption performance of other parts than connectors, difference in displacement between male terminals has decreased and there is a smaller difference in displacement between terminals to be absorbed by the connector. Thus, it seems possible to sufficiently absorb the difference in displacement between male terminals without the coupling spring coupling at the side walls of two female terminals farthest apart from each other as in the connector structures of the related art.

The present disclosure provides a connector that can absorb displacement between terminals and allows one to easily perform a check for the fit of the terminals with each other, an electrical inspection on the terminals, etc.

A connector according to a first aspect of the present disclosure includes: a housing having a substantially box shape with an opening in an upper part; and a female connection terminal housed inside the housing, and including a first female terminal having a substantially cylindrical shape with openings at one end and another end, and allowing a first male terminal to be inserted thereinto from the one end, a second female terminal having a substantially cylindrical shape with openings at one end and another end, and allowing a second male terminal to be inserted thereinto from the one end, and a coupling spring coupling together the first female terminal and the second female terminal at the other end of the first female terminal and the other end of the second female terminal that are located on the opening side of the housing, the coupling spring connecting the first female terminal and the second female terminal to each other without, when viewed from an upper side, overlapping at least one of the openings of the first female terminal on the other end side and at least one of the openings of the second female terminal on the other end side.

The connector according to the first aspect can absorb displacement between the two female terminals (two male terminals) by the coupling spring. Moreover, as the coupling spring does not overlap the openings of the two female terminals, the openings of the two female terminals can be prevented from being covered by the coupling spring. Accordingly, this connector allows the male terminals inserted into the female terminals to be visually checked from above the coupling spring. In addition, the leading ends of the male terminals can be protruded to the upper side through the openings of the female terminals. Thus, this connector allows one to easily perform a check for the fit of the terminals with each other, an electrical inspection on the terminals, etc.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1A:
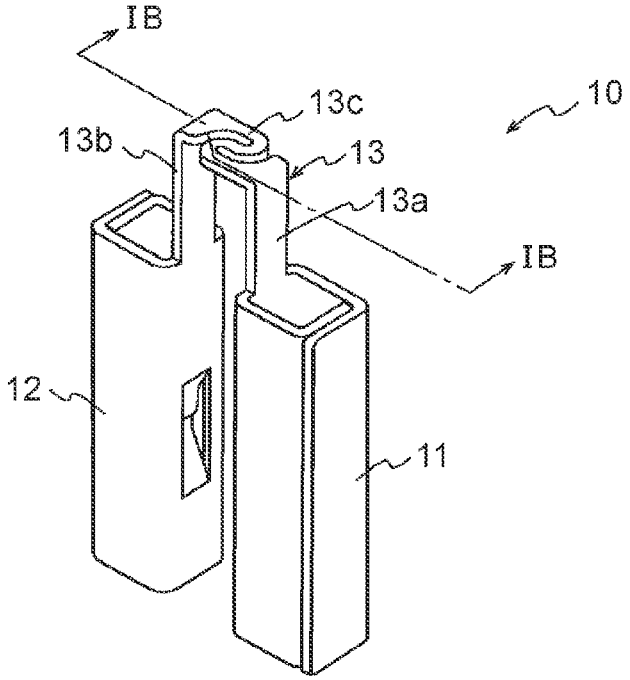
FIG. 1A is an external perspective view schematically showing a female connection terminal that constitutes a part of a connector according to an embodiment of the present disclosure.

The present disclosure relates to a connector including a female connection terminal that links between two male terminals extending substantially in parallel to each other. The female connection terminal has two female terminals, one substantially cylindrical female terminal allowing one of the male terminals to be inserted thereinto and the other substantially cylindrical female terminal allowing the other male terminal to be inserted thereinto, coupled together by a coupling spring. The coupling spring couples at points at which the two female terminals are closest to each other so as not to overlap the openings of these female terminals. Accordingly, the male terminals inserted into the female terminals can be visually checked from above (i.e., from an upper side of a housing described later) the coupling spring. Thus, it is possible to absorb displacement between the terminals as well as to easily perform a check for the fit of the terminals with each other etc. In this disclosure, the "upper part" and the "upper side" indicate the "upper part" and the "upper side" when the connector is placed such that the housing is opened upward. However, the placement of the connector is not limited to this placement.

In the following, one embodiment will be described in detail with reference to the drawings.

As shown in FIG. 1A to FIG. 3, a connector 1 according to this embodiment includes at least a female connection terminal 10 and a housing 20 housing the female connection terminal 10. The connector 1 is a part electrically connecting between a first male terminal 30 that protrudes from a surface of a substrate 50 and a second male terminal 40 that protrudes from the surface of the substrate 50 through a through-hole of the substrate 50 and is substantially parallel to the first male terminal 30.

The first male terminal 30 is fixed on the surface of the substrate 50, while the second male terminal 40 is fixed on a device (such as a power module or an electrical device) disposed on the side of the rear surface of the substrate 50. Accordingly, the first male terminal 30 and the second male terminal 40 have different forms of vibration. The connector 1 according to this embodiment serves to reduce deformation and damage caused by the difference in form of vibration (difference in displacement) between the first male terminal 30 and the second male terminal 40.

The constituents of the connector 1 and the first male terminal 30 and the second male terminal 40 will be described below.

Figure 1B:
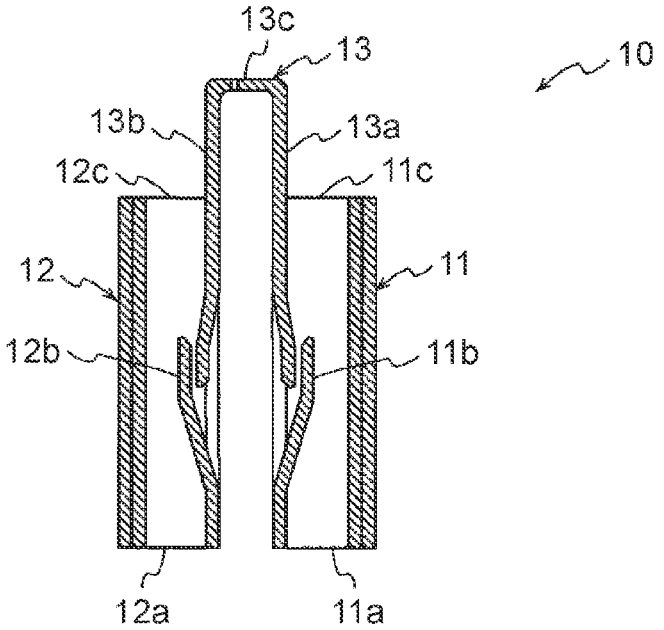
FIG. 1B is a sectional view taken along the line IA-IA of FIG. 1A.
Figure 2A:
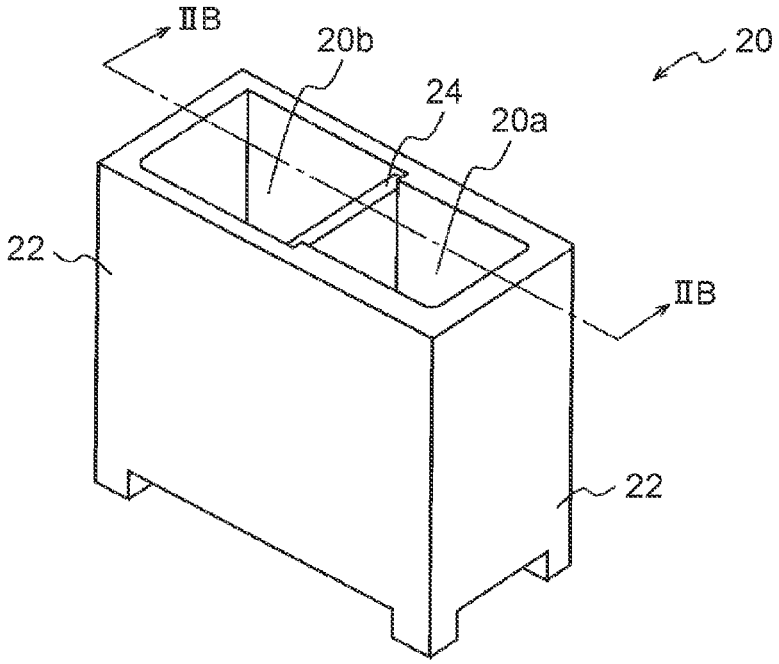
FIG. 2A is an external perspective view schematically showing a housing that constitutes a part of the connector according to the embodiment of the present disclosure.
Figure 2B:
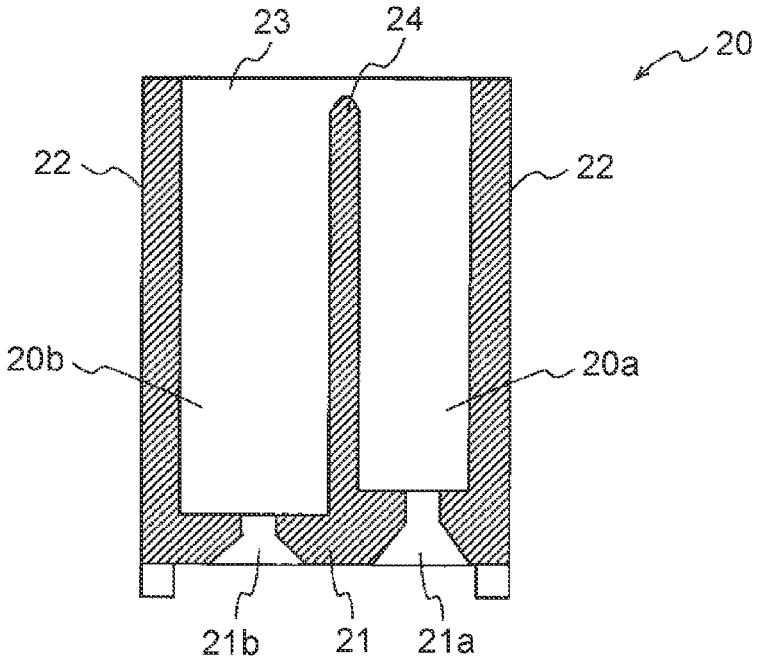
FIG. 2B is a sectional view taken along the line IIB-IIB of FIG. 2A.
Figure 3:
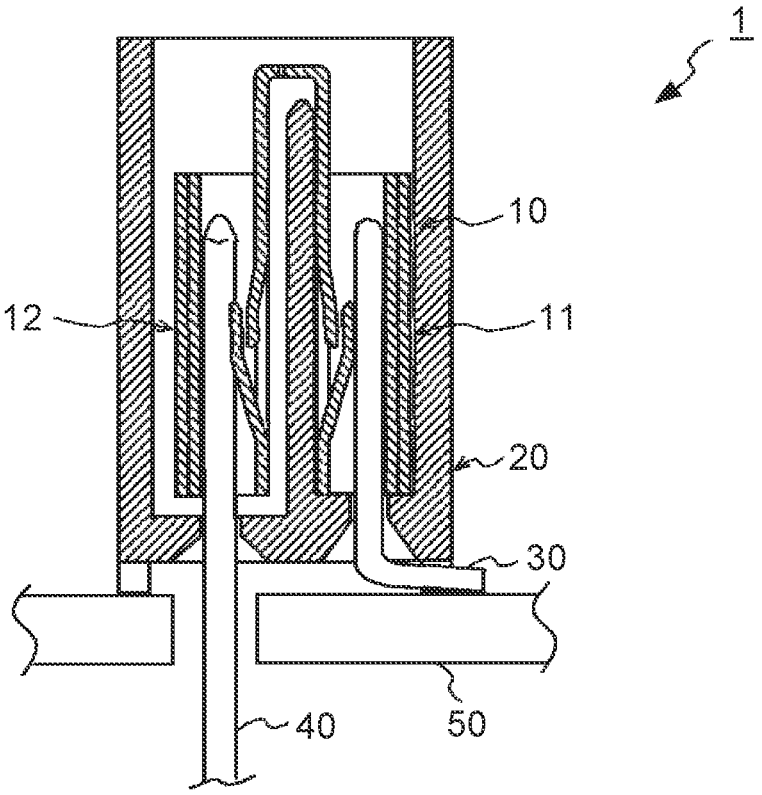
FIG. 3 is a sectional view of the connector according to the embodiment, as mounted on a substrate with male terminals and the female connection terminal connected to each other.

As shown in FIG. 1A, FIG. 1B, and FIG. 3, the female connection terminal 10 is an electrical connection terminal made of a conductive metal member or the like, and is composed of a first female terminal 11, a second female terminal 12, and a coupling spring 13. The first female terminal 11, the second female terminal 12, and the coupling spring 13 of the female connection terminal 10 are integrally formed by cutting and bending a metal plate, for example.

The first female terminal 11 has a hollow, substantially cylindrical shape with an opening at a one end 11*a*, through which the first male terminal 30 is inserted. In the example shown in FIG. 1A, FIG. 1B, and FIG. 3, the first female terminal 11 has a rectangular cylindrical shape with a substantially square section. As the first male terminal 30 is inserted into the rectangular cylinder from the side of the opening at the one end 11*a*, the first female terminal 11 is electrically connected to the first male terminal 30. Inside the rectangular cylinder of the first female terminal 11, a pressure contact mechanism 11*b* (e.g., a leaf spring) is provided that applies a pressure load to the first male terminal 30 inserted and thereby maintains the electrically connected state. The first female terminal 11 also has an opening at another end 11*c* being on the opposite side from the one end 11*a*, and the coupling spring 13, to be descried later, is connected to the first female terminal 11 without covering the opening at the other end 11*c*.

The second female terminal 12 has a hollow, substantially cylindrical shape with an opening at a one end 12*a* through which the second male terminal 40 is inserted. In the example shown in FIG. 1A, FIG. 1B, and FIG. 3, the second female terminal 12 has a rectangular cylindrical shape with a substantially square section. As the second male terminal 40 is inserted into the rectangular cylinder from the side of the opening at the one end 12*a*, the second female terminal 12 is electrically connected to the second male terminal 40. Inside the rectangular cylinder of the second female terminal 12, a pressure contact mechanism 12*b* (e.g., a leaf spring) is provided that applies a pressure load to the second male terminal 40 inserted and thereby maintains the electrically connected state. The second female terminal 12 also has an opening at another end 12*c* being on the opposite side from the one end 12*a*, and the coupling spring 13, to be described later, is connected to the second female terminal 12 without covering the opening at the other end 12*c*.

In the female connection terminal 10 of this embodiment, the first female terminal 11 and the second female terminal 12 have the same shape and are fool-proofed. However, these female terminals may be formed such that the connection part to which the first male terminal 30 is connected and the connection part to which the second male terminal 40 is connected are clearly distinguished from each other.

The coupling spring 13 is an elastically deformable member linking between the first female terminal 11 and the second female terminal 12. The coupling spring 13 is composed of a first extension part 13*a*, a second extension part 13*b*, and a connection part 13*c*.

As shown in FIG. 1A, FIG. 1B, and FIG. 3, the first extension part 13*a* extends from the other end 11*c* of a side wall, facing the second female terminal 12, of the first female terminal 11 along the surface of the side wall. The second extension part 13*b* extends from the other end 12*c* of a side wall, facing the first female terminal 11, of the second female terminal 12 along the surface of the side wall. Thus, the first extension part 13*a* and the second extension part 13*b* are provided substantially in parallel to each other.

The connection part 13*c* is shaped like a so-called beam that connects between the leading end of the first extension part 13*a* and the leading end of the second extension part 13*b* so as not to overlap the opening of the first female terminal 11 and the opening of the second female terminal 12 (so as not to cover the openings). The connection part 13*c* is configured to be elastically deformable under a small force such that the first female terminal 11 and the second female terminal 12 can be displaced independently of each other. Specifically, being formed in an S-shape as shown in FIG. 1A and FIG. 1B, the connection part 13*c* has a small spring constant and is easily deflectable mainly in the insert direction of the first male terminal 30 and the second male terminal 40.

Thus, the coupling spring 13 couples together the first female terminal 11 and the second female terminal 12 substantially in parallel to each other without overlapping the opening of the first female terminal 11 at the other end 11*c* and the opening of the second female terminal 12 at the other end 12*c* (without covering the openings).

When the female connection terminal 10 is installed in the housing 20, the first female terminal 11 is fixed on the housing 20, while the second female terminal 12 is in a free state without being fixed or restrained on the housing 20. Thus, the coupling spring 13 (connection part 13*c*) functions as a cantilever beam with the end connected to the first extension part 13*a* acting as the fixed end.

The housing 20 is made of an insulating resin material or the like, and houses the female connection terminal 10. As can be understood from FIG. 2A, FIG. 2B, and FIG. 3, the housing 20 is a substantially box-shaped part composed of a bottom (baseplate) 21 on the side in contact with (facing) the substrate 50 and four side walls 22 adjoining the peripheral edge of the bottom 21.

The bottom 21 is provided with an insert hole 21*a* through which the first male terminal 30 is inserted. The insert hole 21*a* has a hole diameter larger than the outer peripheral diameter of the first male terminal 30, and an insert opening for the first male terminal 30 is forward-tapered so as to decrease in open area in the insert direction. The bottom 21 is further provided with an insert hole 21*b* through which the second male terminal 40 is inserted. The insert hole 21*b* has a hole diameter larger than the outer peripheral diameter of the second male terminal 40, and an insert opening for the second male terminal 40 is forward-tapered so as to decrease in open area in the insert direction. An opening 23 through which the female connection terminal 10 is inserted is formed in an upper part of the housing 20 on the opposite side from the bottom 21.

Inside the housing 20, a partition 24 is formed that divides the inside into a first housing section 20*a* housing the first female terminal 11 of the female connection terminal 10 and a second housing section 20*b* housing the second female terminal 12 of the female connection terminal 10.

The first female terminal 11 of the female connection terminal 10 housed in the first housing section 20*a* is restrained at a prescribed position inside the housing 20 by a protrusion (not shown) and prevented from slipping out.

The one end 12*a* of the second female terminal 12 of the female connection terminal 10 housed in the second housing section 20*b* is located at a distance from the bottom 21 of the housing 20, and there is a clearance between the side walls 22 and the partition 24 in the periphery of the second female terminal 12. The second female terminal 12 is clearance-fitted at a prescribed position inside the housing 20 by a protrusion (not shown) and prevented from slipping out. That is, the second female terminal 12 is suspended inside the second housing section 20*b* through the coupling spring 13.

The first male terminal 30 is an electrical connection terminal made of a conductive metal member or the like. One end of the first male terminal 30 is fixed by soldering, for example, and electrically connected to a predetermined terminal (point) of the substrate 50. The other end of the first male terminal 30 is connected to the first female terminal 11 of the female connection terminal 10. The first male terminal 30 illustrated in this embodiment is a substantially L-shaped male-type terminal formed by bending a rod-like member at such a position that the linear portion is longer on the other end side than on the one end side (e.g., see FIG. 3). However, the first male terminal 30 may have a shape other than the substantial L-shape shown in FIG. 3.

The second male terminal 40 is an electrical connection terminal made of a conductive metal member or the like. One end of the second male terminal 40 is fixed and electrically connected to a predetermined terminal (point) of a device (not shown). This device does not have a mechanically restrictive relationship with the substrate 50. Accordingly, when a higher-level device including this device and the substrate 50 vibrates, the device and the substrate 50 are subjected to different forms of vibration, so that the first male terminal 30 and the second male terminal 40 are also subjected to different forms of vibration.

In the connector 1 of this embodiment configured as has been described above, even when the first female terminal 11 is subjected to vibration and displaced along with the housing 20, the second female terminal 12, which is coupled in a suspended state with the first female terminal 11 through the coupling spring 13, is not displaced by following the housing 20 in the case of vibration within a predetermined range. Thus, the first female terminal 11 and the second female terminal 12 can be displaced relative to and independently of each other, so that deformation and damage can be reduced even if the substrate 50 on which the first female terminal 11 is fixed and the device on which the second female terminal 12 is fixed have different forms of vibration.

Figure 4A:
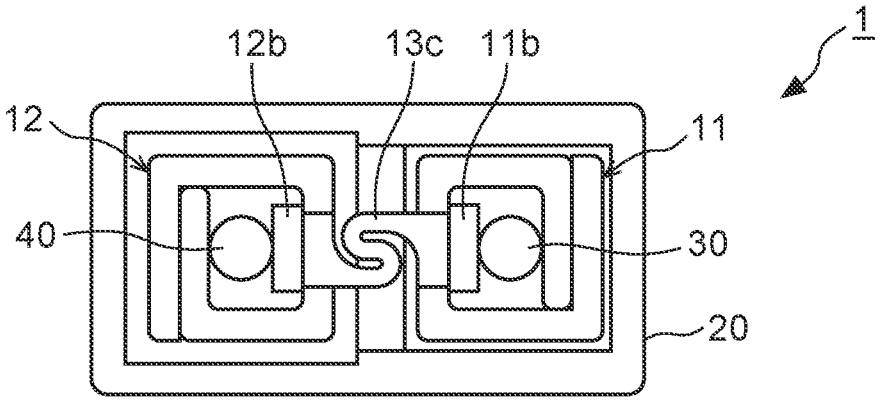
FIG. 4A is a view illustrating effects of the connector according to the embodiment.

In the connector 1 of this embodiment configured as has been described above, the coupling spring 13 couples together the first female terminal 11 and the second female terminal 12 substantially in parallel to each other without overlapping the opening of the first female terminal 11 at the other end 11*c* and the opening of the second female terminal 12 at the other end 12*c* (without covering the openings). Accordingly, as shown in FIG. 4A, it is possible to view the state inside the housing 20 through the opening 23 of the housing 20 (from an upper side of the connector 1) after fitting the connector 1 with the first male terminal 30 and the second male terminal 40. Thus, the connector 1 of this embodiment allows one to easily check the state of fit (contact) between the first female terminal 11 and the first male terminal 30 and the state of fit (contact) between the second female terminal 12 and the second male terminal 40.

Figure 4B:
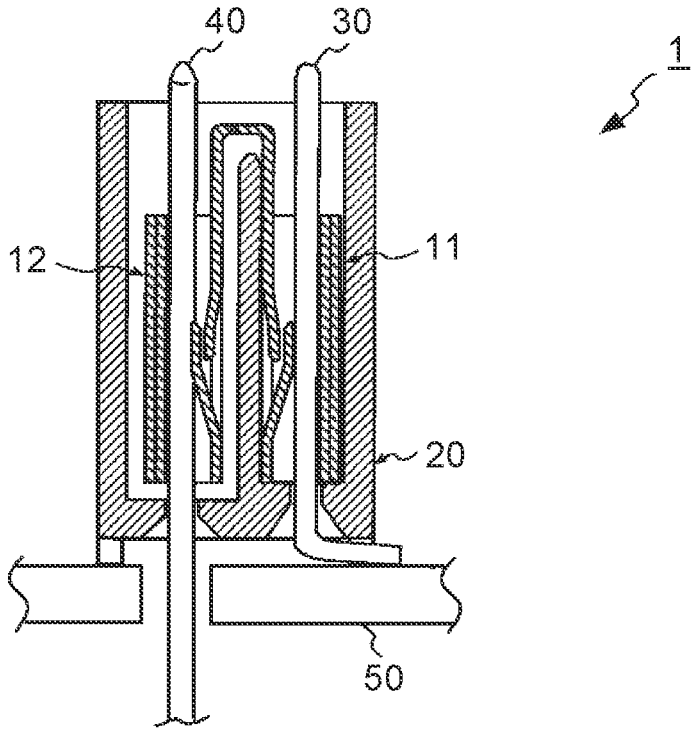
FIG. 4B is a view illustrating the effects of the connector according to the embodiment.

In the connector 1 of this embodiment configured as has been described above, the coupling spring 13 couples together the first female terminal 11 and the second female terminal 12 substantially in parallel to each other without overlapping the opening of the first female terminal 11 at the other end 11*c* and the opening of the second female terminal 12 at the other end 12*c* (without covering the openings). Accordingly, if a first male terminal 30 and a second male terminal 40 having a dimension equal to or longer than a predetermined dimension are fitted with the connector 1, the leading ends of the first male terminal 30 and the second male terminal 40 can be protruded through the other ends 11*c*, 12*c* of the first female terminal 11 and the second female terminal 12 (or through the upper surface of the connector 1) as shown in FIG. 4B. Thus, the connector 1 of this embodiment allows one to directly touch the first male terminal 30 and the second male terminal 40 having been fitted, and to easily perform a check, such as an electrical inspection.

As has been described above, according to the connector 1 of the embodiment of the present disclosure, the coupling spring 13 of the female connection terminal 10 couples together the first female terminal 11 and the second female terminal 12 at points at which these female terminals are closest to each other. Specifically, the coupling spring 13 couples together the substantially rectangular cylindrical first female terminal 11 and second female terminal 12 at the opposite side walls that are closest to each other. The coupling spring 13 connects by the connection part 13*c* between the leading end of the first extension part 13*a* and the leading end of the second extension part 13*b* that extend respectively from the other ends 11*c* and 12*c* of the opposite side walls of the first female terminal 11 and the second female terminal 12 along the surfaces of the side walls. Thus, the coupling spring 13 can absorb displacement between the first female terminal 11 and the second female terminal 12 (the first male terminal 30 and the second male terminal 40).

The openings of the first female terminal 11 and the second female terminal 12 do not overlap the connection part 13*c* of the coupling spring 13 (the openings are not covered by the connection part 13*c*). Thus, the connector 1 allows the first male terminal 30 inserted into the first female terminal 11 and/or the second male terminal 40 inserted into the second female terminal 12 to be visually checked from above the coupling spring 13. Moreover, the connector 1 allows the leading end of the first male terminal 30 to be protruded to the upper side beyond the other end 11*c* of the first female terminal 11, and/or allows the leading end of the second male terminal 40 to be protruded to the upper side beyond the other end 12*c* of the second female terminal 12. Thus, this connector allows one to easily perform a check for the fit of the terminals with each other, an electrical inspection on the terminals, etc., and to thereby improve the reliability of detection and processing of malfunction. This will ultimately lead to improved security and safety of the vehicle.

The coupling spring 13 illustrated in the above embodiment has the S-shaped connection part 13*c* and is elastically deformable. However, the connection part 13*c* of the coupling spring 13 may have a shape other than the S-shape as long as the coupling spring 13 is elastically deformable. In the case where there is no difference in form of vibration between the first male terminal 30 and the second male terminal 40, the coupling spring 13 may connect the first female terminal 11 and the second female terminal 12 to each other by a connection part 13*c* that does not elastically deform.

The connector of the present disclosure can be used where it is desired to be able to absorb displacement between terminals as well as to easily perform a check for the fit of the terminals with each other, an electrical inspection on the terminals, etc.

What is claimed is:

1. A connector comprising:

a housing having a substantially box shape with an opening in an upper part; and a female connection terminal housed inside the housing, the female connection terminal including:

a first female terminal having a substantially cylindrical shape with openings at one end and another end, and allowing a first male terminal to be inserted thereinto from the one end;

a second female terminal having a substantially cylindrical shape with openings at one end and another end, and allowing a second male terminal to be inserted thereinto from the one end; and a coupling spring coupling together the first female terminal and the second female terminal at the other end of the first female terminal and the other end of the second female terminal that are located on the opening side of the housing, the coupling spring connecting the first female terminal and the second female terminal to each other without, when viewed from an upper side, overlapping at least one of the openings of the first female terminal on the other end side and at least one of the openings of the second female terminal on the other end side.

2. The connector according to claim 1, wherein the coupling spring couples together the first female terminal and the second female terminal at points at which the first female terminal and the second female terminal are closest to each other.

3. The connector according to claim 1, wherein the coupling spring is composed of a first extension part extending from the other end of the first female terminal, a second extension part extending from the other end of the second female terminal, and a connection part connecting a leading end of the first extension part and a leading end of the second extension part to each other.

4. The connector according to claim 3, wherein the connection part is configured to be elastically deformable in an insert direction of the first male terminal and the second male terminal.

5. The connector according to claim 1, wherein the first female terminal is fixed on the housing, while the second female terminal is clearance-fitted at a prescribed position inside the housing.

6. The connector according to claim 5, wherein the second female terminal has a clearance from the housing.

7. The connector according to claim 1, wherein the first female terminal, the second female terminal, and the coupling spring of the female connection terminal are integrally formed by cutting and bending a metal plate.

8. The connector according to claim 1, wherein the female connection terminal is configured so as to allow a leading end of the first male terminal inserted into the first female terminal to be protruded to the upper side beyond the other end of the first female terminal, and to allow a leading end of the second male terminal inserted into the second female terminal to be protruded to the upper side beyond the other end of the second female terminal.

9. The connector according to claim 8, wherein the housing is configured such that the first male terminal and the second male terminal protrude through an upper surface of the housing.

* * * * *